US006691419B2

(12) United States Patent
Chang

(10) Patent No.: US 6,691,419 B2
(45) Date of Patent: Feb. 17, 2004

(54) CAN OPENER WITH TWO PIVOTALLY CONNECTED LEVERS IN LAID DOWN POSITION

(75) Inventor: Kun-Jen Chang, Yung Kang (TW)

(73) Assignee: Alston Technologies Development Co., Ltd., Tainan Hsien (TW)

( * ) Notice: Subject to any disclaimer, the term of this patent is extended or adjusted under 35 U.S.C. 154(b) by 0 days.

(21) Appl. No.: 10/191,525

(22) Filed: Jul. 10, 2002

(65) Prior Publication Data

US 2004/0006877 A1 Jan. 15, 2004

(51) Int. Cl.[7] ..... B67B 7/72
(52) U.S. Cl. ..... 30/417; 30/416
(58) Field of Search ..... 30/417, 418, 416, 30/422; D8/37, 41

(56) References Cited

U.S. PATENT DOCUMENTS 5,121,546 A * 6/1992 Chong ..... 30/418
5,367,776 A * 11/1994 Chong ..... 30/417
5,946,811 A * 9/1999 Chang ..... 30/417
6,094,828 A * 8/2000 Chong ..... 30/417
6,101,727 A * 8/2000 Chong ..... 30/418
6,148,527 A * 11/2000 Pereira ..... 30/417

* cited by examiner

*Primary Examiner*—Hwei-Siu Payer
(74) *Attorney, Agent, or Firm*—Rosenberg, Klein & Lee

(57) ABSTRACT

A can opener includes a first lever, and a second lever pivotally connected to the first lever. The levers are in laid down position when a cutting wheel of the can opener is cutting a can. The first lever is equipped with a first wheel having domed protrusions spaced around the center. The second lever is equipped with a second wheel having main round recesses spaced around the center. Smaller round recesses and curved trenches are formed between the main recesses; the curved trenches are similar to annular trenches provided on trust block seating of thrust ball bearings. The first, and the second wheels are disposed face to face so as to help prevent change of position of the pivotal axis of the levers in the course of one of the levers moving relative to the other, helping the can opener operated with precision.

2 Claims, 8 Drawing Sheets

CAN OPENER WITH TWO PIVOTALLY CONNECTED LEVERS IN LAID DOWN POSITION

BACKGROUND OF THE INVENTION

The present invention relates to a can opener with two pivotally connected levers in laid down position, and more particularly a can opener, which ensures that the cut around the periphery of the top forms a loop, and which can be operated smoothly.

To avoid shavings formed in can openers opening a can from contaminating the contents of the can, and to prevent the cut can top from falling into the can contents, can openers have been developed that are designed to cut the outside seam wall at the top of the can.

Referring to FIGS. 9 and 10, a can opener designed with the above mentioned function, disclosed in U.S. Pat. No. 5,121 546, includes a housing 40, a cutting wheel 80, and a traction wheel 140. The cutting wheel 80 has a spindle defining a cutting wheel axis, while the traction wheel 140 has a spindle 180 defining a traction wheel axis. A fixed thrust surface fixed to the housing and a movable thrust surface associated with the traction wheel spindle are provided. A finger-actuated lever 380 is pivoted to the housing, and can be inserted into between the thrust surfaces from a throat section equipped with ball bearings 320 such that the movable thrust surface is moved away from the fixed thrust surface to move the traction wheel closer to the cutting wheel. Both the traction wheel 140 and the cutting wheel 80 define a gap adapted to accept a can seam wall to be opened. When the lever 380 is moved close to a handle 60 of the housing 40, the spindle 180 is moved along the axis so that the traction wheel 140 is moved toward the cutting wheel 140 to close the gap thereby engaging and locking the can between the cutting wheel and the traction wheel; the traction wheel acts to move the can past the cutting wheel for allowing the cutting wheel to cut the outer wall of the can when a knob 360 connected to the spindle 180 is turned.

In this regard, the ball bearings 320 provide a bearing surface to allow thrust surface 280 affixed to the spindle 180 to rotate freely with respect to fixed traction surface 260. However, the traction wheel is subject to diversion in the course of turning because the ball bearings 320 are not spaced apart, hindering the smooth operation of the can opener. Furthermore, abutment means are provided for guiding the movement of the can opener about the can during a cutting operation, which include a shoulder adapted to abut the top and outside seam wall edges in front of the cutting and traction wheels. However, when the section of the can that has been passed through the opener, and cut by the cutting wheel is moved under the shoulder, the opener is likely to be displaced from the original appropriate position because this can section is raised due to the cutting. Consequently, the cut around the periphery of the can top fails to form a loop, hindering easy removal of the can top.

Referring to FIG. 11, another can opener, disclosed in U.S. Pat. No. 5,367,776, includes a handle, a first thrust surface 260 associated with the housing and a spaced, adjacent, second thrust surface 280 associated with the movable wheel. The first and second thrust surfaces comprises cooperable cam surfaces rotatable relative to each other to reciprocate the first and second thrust surfaces relative to each other between a first position where a gap between a cutting wheel and a traction wheel to receive a can seam wall is relatively wide, and a second position where the can seam wall is engaged and locked between the cutting wheel and the traction wheel. The handle permits one of the wheels to be rotated by hand. This structure overcomes the drawback of the last can opener that the traction wheel is subject to diversion in the course of turning because the ball bearings are not spaced apart. However, the traction wheel and the cutting wheel fail to squeeze the can seam wall firmly in between like the last opener. In addition, a space must be provided between the lever and the handle for allowing easy downward movement of the lever. Consequently, the lever is prone to unwantedly move in sideways direction that is different from the intended one of the pivotal movement, therefore it would be relatively difficult to move the lever down, and the lever would cause deformation of the spindle if forced to move down. And, movement guiding abutment means provided to it has the same drawback as the last opener.

Referring to FIG. 12, the inventor of the present invention has invented a can opener disclosed in U.S. Pat. No. 5,946, 811 plus Taiwan patent no. 327896. However, this can opener also has the same disadvantages as the above mentioned ones.

SUMMARY OF THE INVENTION

Therefore, it is a main object of the present invention to provide a can opener, which can be operated smoothly and with precision.

It is another object of the present invention to provide a can opener, which ensures that the cut around the periphery of the can forms a loop for allowing easy removal of the can top.

The present can opener includes a first lever, and a second lever pivotally connected to the first lever. The levers are held in laid down position for allowing a traction wheel and a cutting wheel to squeeze a top seam wall of a can. The first lever is equipped with a first wheel having domed protrusions spaced around the center. The second lever is equipped with a second wheel having first recesses spaced around the center. Shallower second recesses and shallowest curved trenches are formed between the first recesses; the curved trenches are similar to annular trenches provided on trust block seating of thrust ball bearings. Spindle of the traction wheel is passed through the centers of the wheels of the levers to be affixed to an actuating member. The traction wheel is biased to be away from the cutting wheel with springs for a can seam wall to be inserted into between the same when the domed protrusions are held in the first recesses. The second wheel pushes both the first wheel and the actuating member further away from the second lever when the domed protrusions are held right on the curved trenches, making the traction wheel move to squeeze the can wall between same and the cutting wheel such that the can wall are penetrated by the cutting wheel.

BRIEF DESCRIPTION OF THE DRAWINGS

The present invention will be better understood by reference to the accompanying drawings, wherein.

DETAILED DESCRIPTION OF THE PREFERRED EMBODIMENTS

Figure 1:
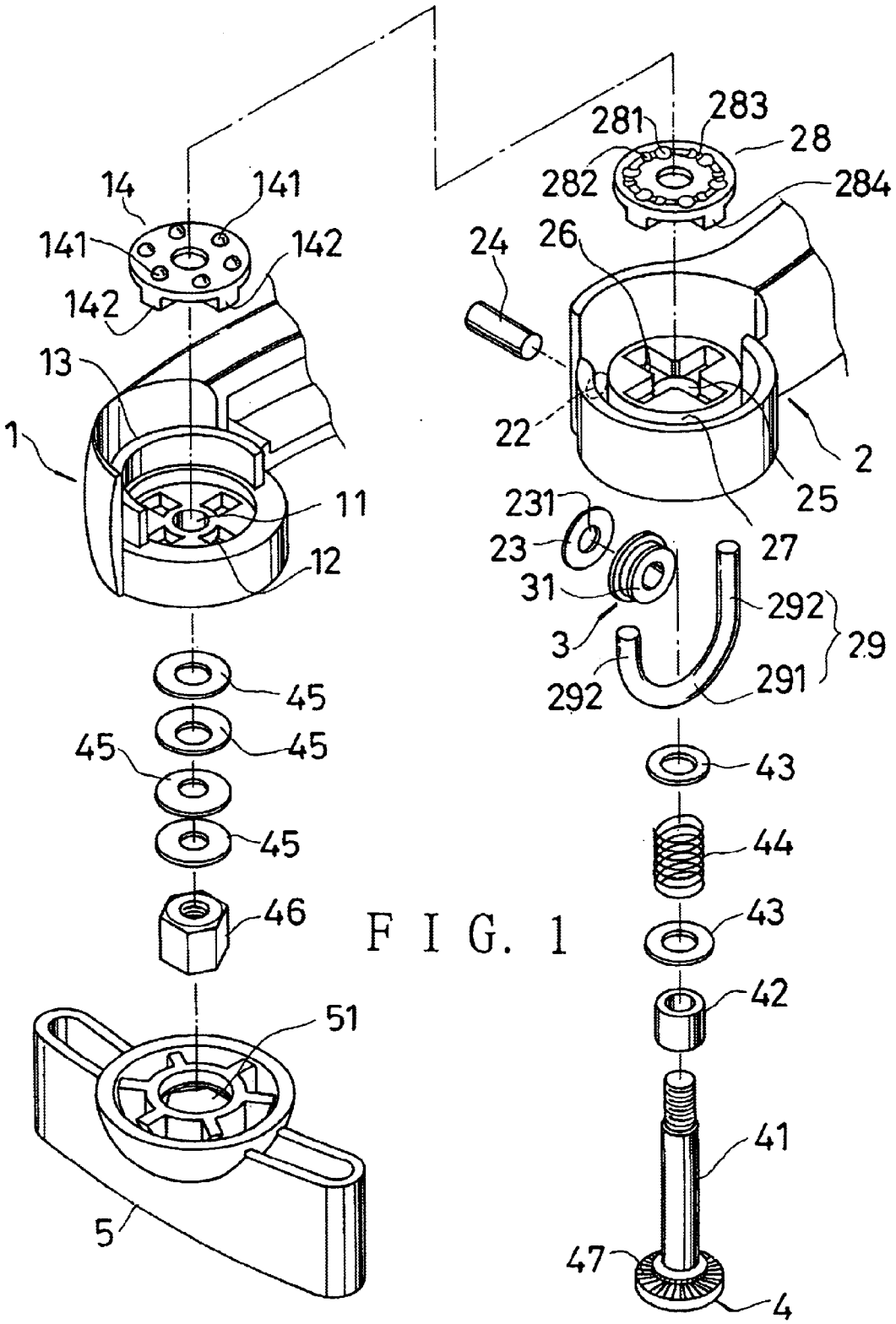
FIG. 1 is an exploded perspective view of the can opener of the present invention.
Figure 2:
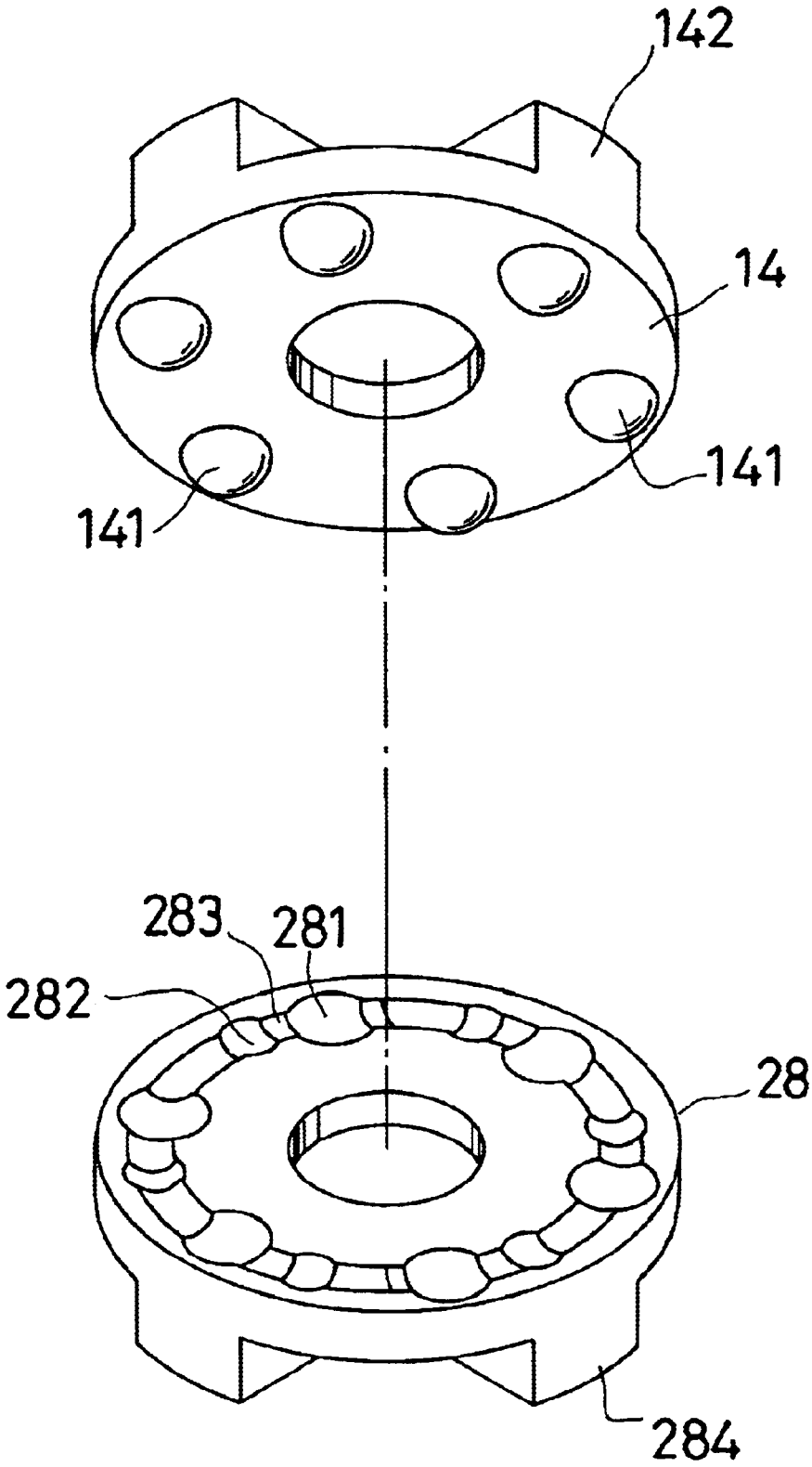
FIG. 2 is a fragmentary exploded perspective view of the can opener of the present invention.

Referring to FIG. 1, a can opener of the present invention includes a first lever 1, a second lever 2, a cutting wheel 3, a traction wheel 4, and an actuating member 5.

The first lever 1 has a first section, which is formed with a round hole 11, several holding holes 12 about the round hole 11, and a stopping wall 13. A first wheel 14 is disposed on the inner side of the first section, one side of which is formed with flat areas and domed protrusions 141 spaced apart on an imaginary circle concentric with the round hole 11. The first wheel 14 has connecting protrusions 142 inserted into respective ones of the holding holes 12 so that it can't possibly turn relative to the first section of the first lever 1.

The second lever 2 has a first section, which is formed with a through hole 25, several holding holes 26 about the through hole 25, and a curved room 27, which is longer than the stopping wall 13 of the first lever 1. A second wheel 28 is disposed on the inner side of the first section of the lever 2, one side of which is formed with flat areas and first spaced recesses 281 spaced apart at corresponding positions of the domed protrusions 141. The second wheel 28 further has second spaced recesses 282 between the first recesses 281, and spaced curved trenches 283 also between the first recesses 281; the curved trenches 283 are similar to annular trenches provided on trust block seating of thrust ball bearings; the first recesses 281 are deeper than the second ones 282, while the second recesses 282 are deeper than the curved trenches 283. The second wheel 28 has connecting protrusions 284 inserted into respective ones of the holding holes 26 so that it can't possibly turn relative to the first section of the second lever 2.

Figure 3:
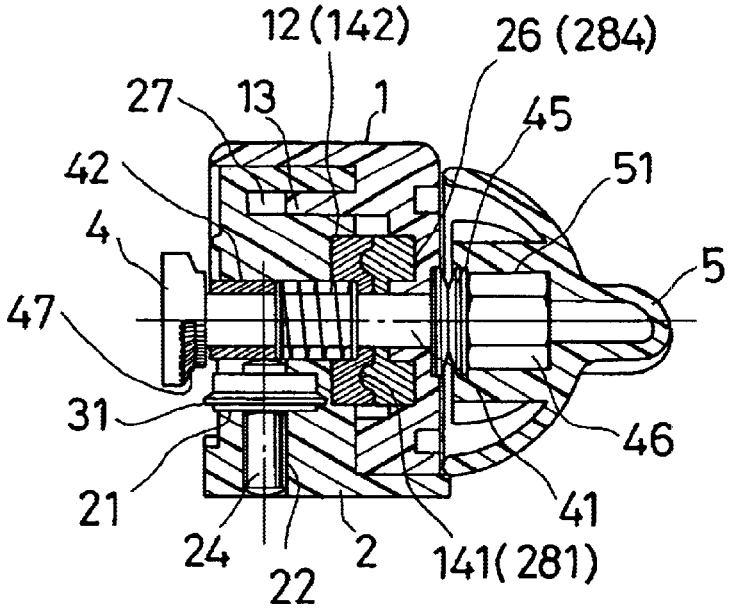
FIG. 3 is a cross-sectional view of the can opener of the present invention.
Figure 4:
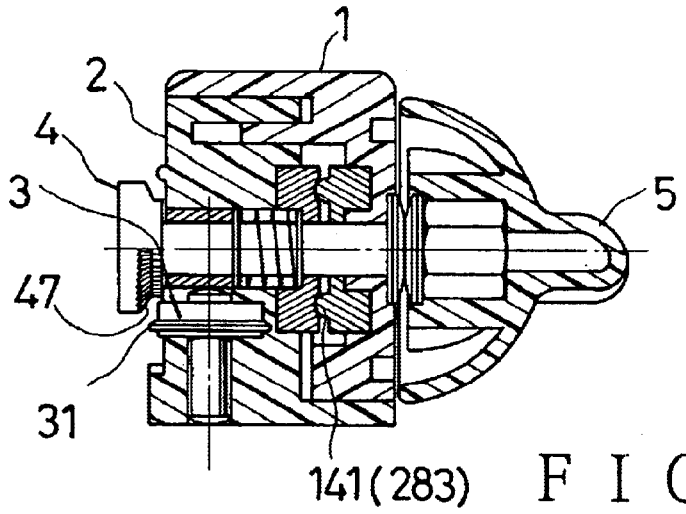
FIG. 4 is a cross-sectional view of the can opener of the present invention under operation.
Figure 6:
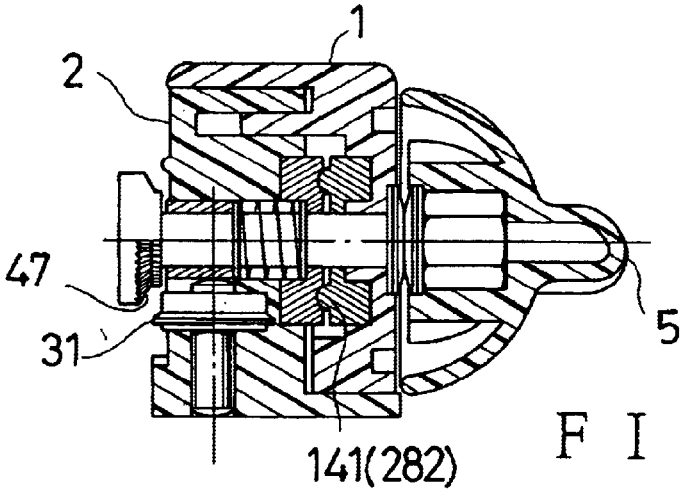
FIG. 6 is another cross-sectional view of the can opener of the present invention under operation.

Referring to FIG. 3, the cutting wheel 3 is received in a receiving hole 21 of the second lever 2, and a center hole thereof is mounted around a spindle 24 passed through a hole 22 of the lever 2; a washer 23 is mounted around the spindle 24 from a central hole 231 to abut the cutting wheel 3. The cutting wheel 3 has a blade 21 formed around the edge and sticking out from the receiving hole 21.

The traction wheel 4 has a gripping surface 47, and a spindle 41 sticking out from the gripping surface 47. The spindle 41 is passed through a sleeve 42, an elastic member 44, and washers 43. The spindle 24 is preferably perpendicular to the traction wheel spindle 41 as shown in FIG. 3.

In combination, the levers 1, 2 are pivoted to each other with the spindle 41 being passed through the through hole 25 and the round hole 11, and with the stopping wall 13 being housed in the curved room 27 so that that side of the first wheel 14 formed with the domed protrusions 141 is faced with the round recesses 281, 282. The elastic member 44 will be retained in the through hole 25 so as to bias the traction wheel 4 away from the levers 1, and 2. The other end of the spindle is passed through several washers 45, and is screwed into a nut 46, which is fixedly disposed in a connecting hole 51 of the actuating member 5 placed adjacent to the first lever 1 so that the traction wheel 4 can turn together with the actuating member 5 in operating the member 5 to sever a can top.

Figure 5:
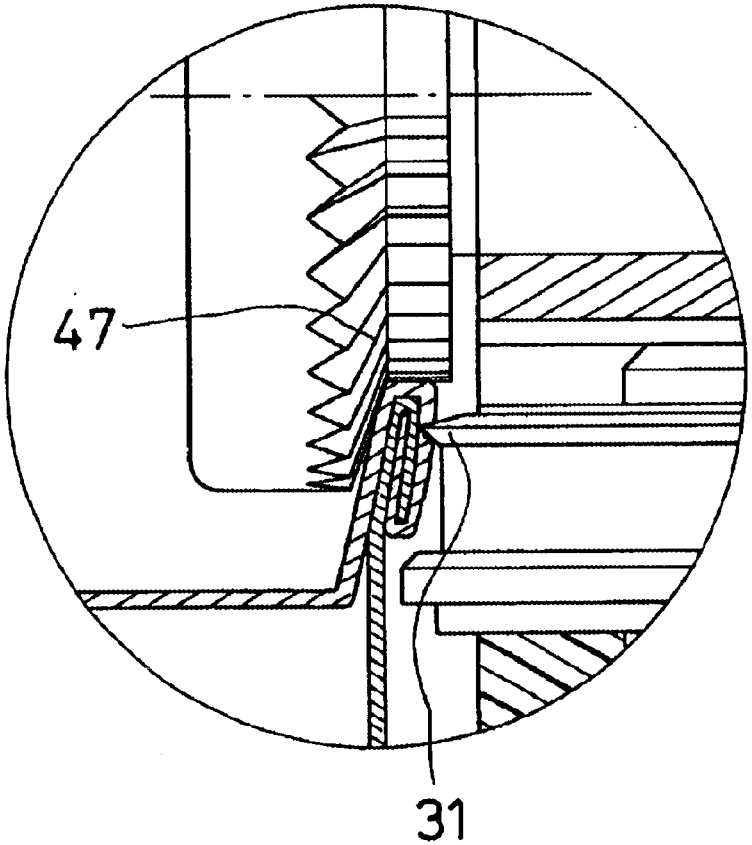
FIG. 5 is a partial enlarged view of the can opener in FIG. 4.

The domed protrusions 141 will be held right in the first recesses 281 when the first and the second levers 1, 2 are pivoted away from each other to not-in-use position, allowing the traction wheel 4 to be biased further away from the cutting wheel 3 by the elastic member 44 associated with the traction wheel. The domed protrusions 141 will be held on the curved trenches 283 when the levers 1, 2 are pivoted towards each other to initiating position where the second wheel 2 pushes both the first wheel 1 and the actuating member 5 further away from it, causing the traction wheel 4 to move closer to the cutting wheel 3 to squeeze the can wall together with the same; thus, the blade 31 penetrates the outer side of the seam wall as shown in FIG. 5.

Figure 7:
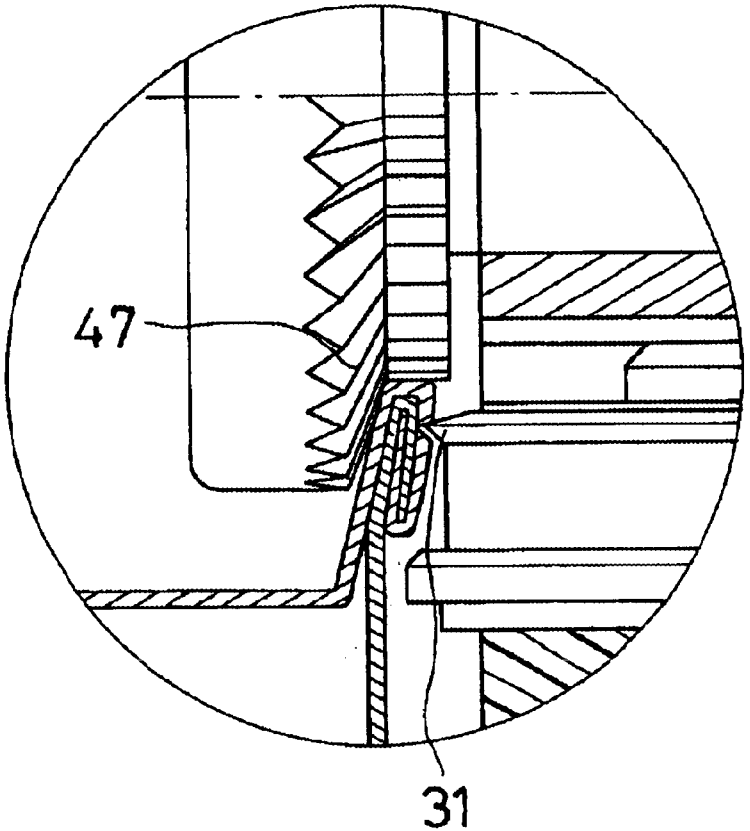
FIG. 7 is a partial enlarged view of the can opener in FIG. 6.
Figure 8:
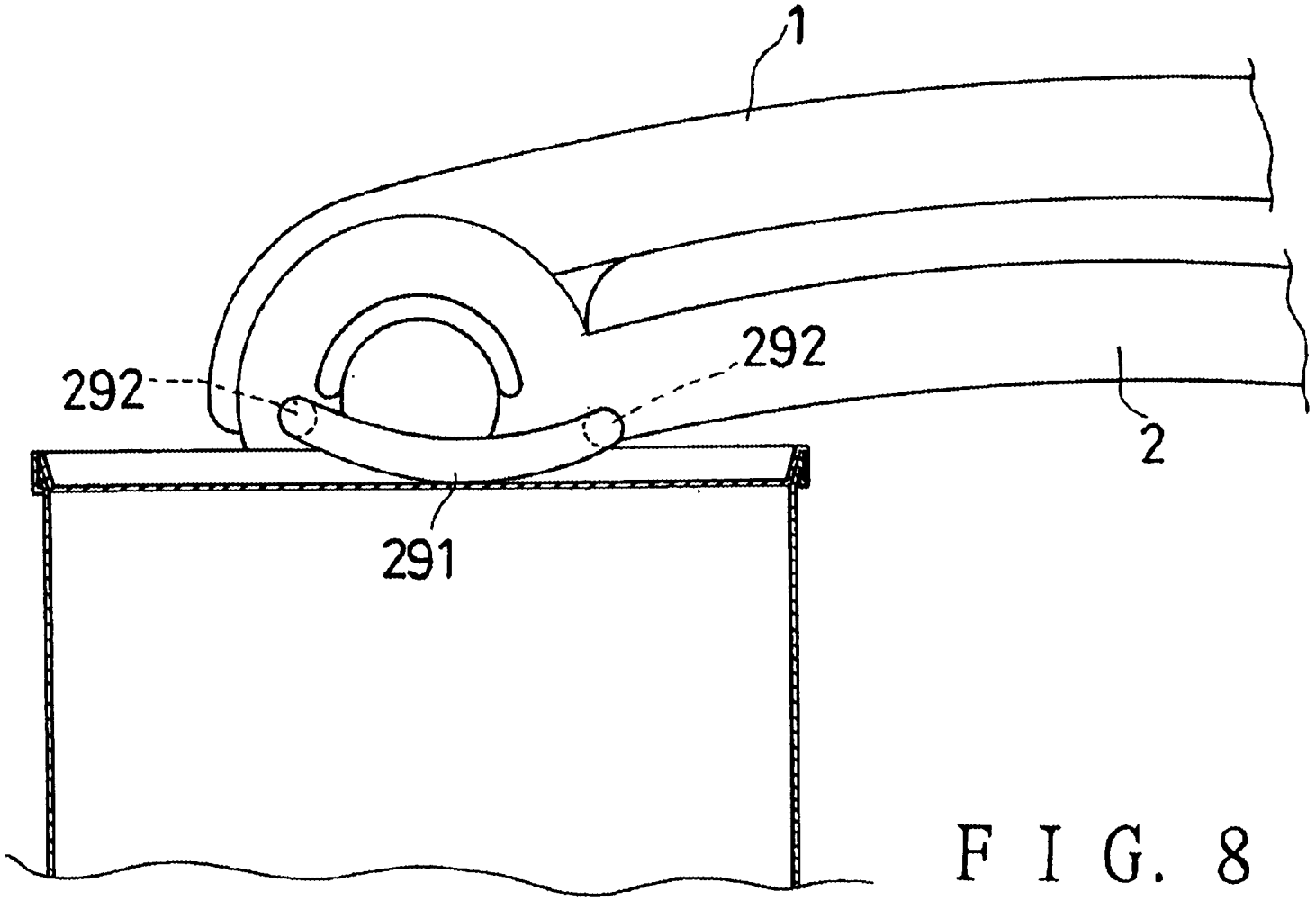
FIG. 8 is a view showing the present can opener being used to cut the outer seam wall of a can.
Figure 10:
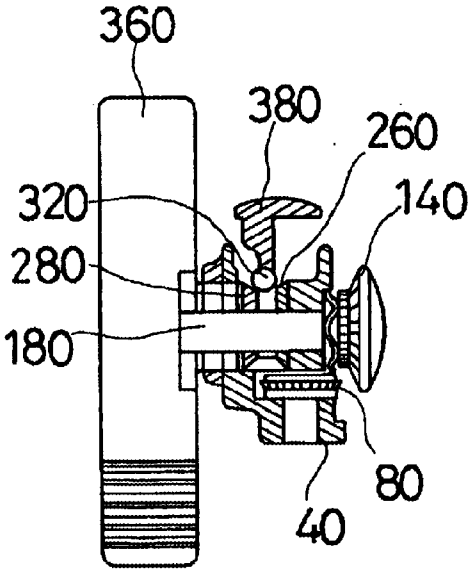
FIG. 10 (PRIOR ART)
FIG. 10 is another view of the first conventional can opener disclosed in U.S. Pat. No. 5,121,546 and described in the Background.
Figure 9:
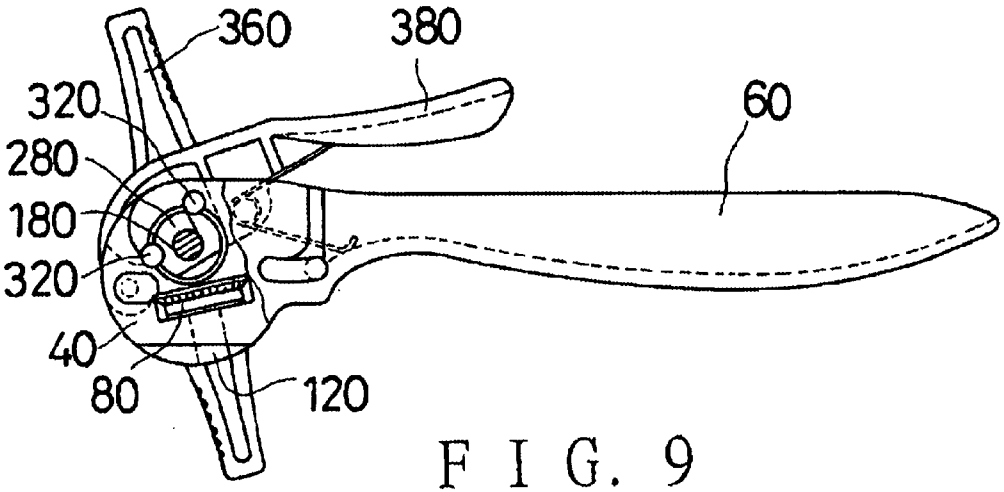
FIG. 9 (PRIOR ART)
FIG. 9 is a view of the first conventional can opener disclosed in U.S. Pat. No. 5,121,546 and described in the Background.
Figure 11:
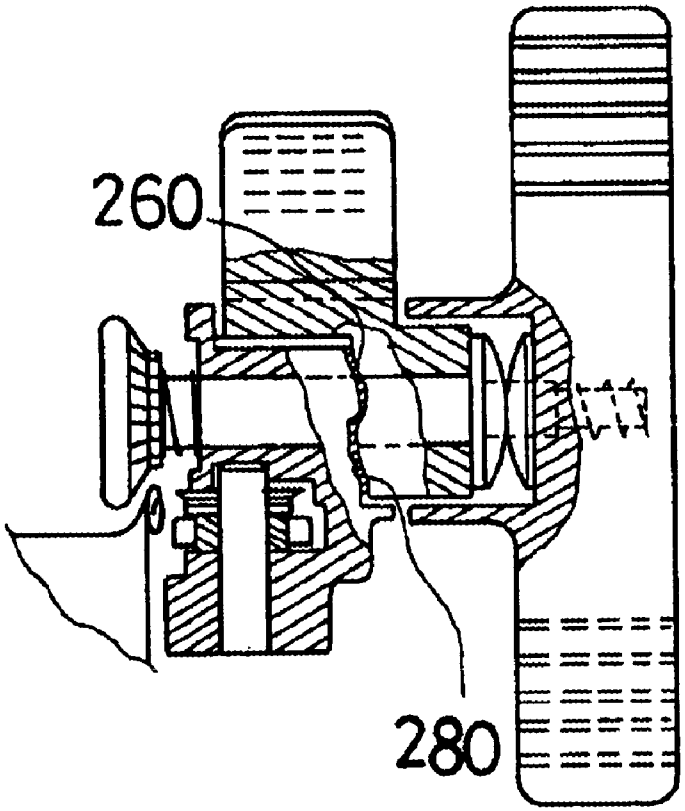
FIG. 11 (PRIOR ART)
FIG. 11 is a view of the second conventional can opener disclosed in U.S. Pat. No. 5,367,776.
Figure 12:
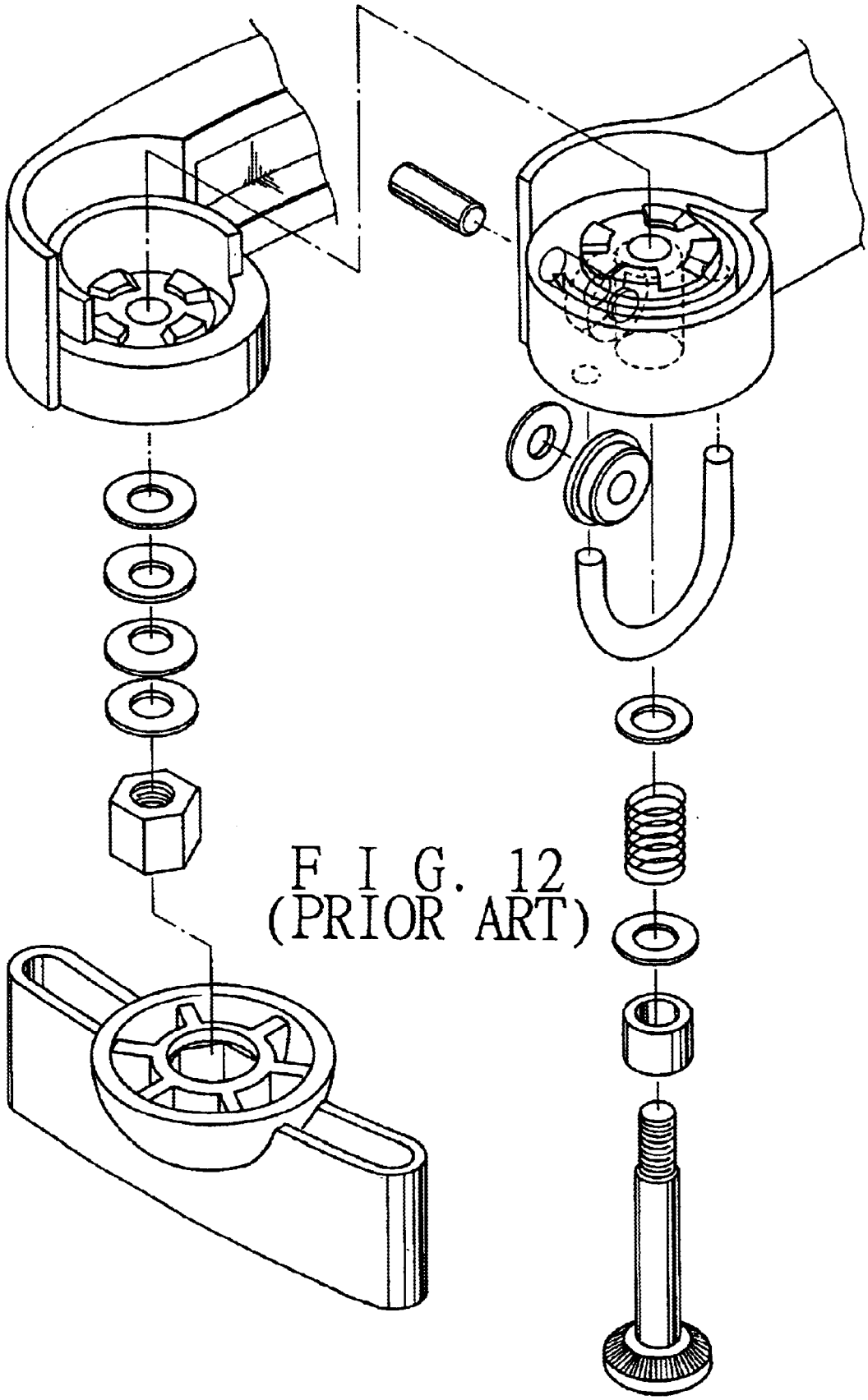
F I G. 12 (PRIOR ART)
FIG. 12 is a view of the third conventional can opener disclosed in U.S. Pat. No. 5,946,811.

The domed protrusions 141 will be held on the second recesses 282 when the levers 1, 2 are pivoted to be extremely close to each other to operating position so that the blade 31 slightly retreats from the inner end of the cut on outer side of the seam wall is shown in FIG. 7. Thus, the traction wheel 4 advances the can seam wall past the cutting wheel 3 for the wheel 3 to sever the wall when the actuating member 5 is turned; the blade 31 still can sever the seam wall in the position shown in FIG. 7; when the blade 31 penetrates the seam wall, the cut of the seam wall becomes an initial position that helps the can opener held on the can stably.

In addition, an abutment member 29 is affixed to the first section of the second lever 2 for guiding the movement of the can in relation to the opener during a cutting operation; the abutment member 29 includes a first and a second straight sections 292. 292, and a curved section 291, which is positioned lower than the first straight section 292 when the can opener is operated. The second straight section is positioned higher than the first straight section. Thus, the first section 292, and the curved section 291 can sit on an edge of a top of the can wall, and a middle portion of the can top respectively to prevent the can from moving up relative to the can opener when the opener is operated, ensuring that the cut around the can seam wall forms a loop to allow easy removal of the can top.

From the above description, it can be easily understood that the present can opener has advantages as followings:

1. Because domed protrusions and corresponding recesses of the first and the second wheels are spaced around the traction wheel spindle axis, flat areas of the first wheel stay parallel to flat areas of the second wheel in a course of one of the levers being pivoted on the other, preventing change of orientation of the axis of the traction wheel spindle, and helping the can opener operated with precision.

2. The second wheel 28 will displace the traction wheel 4 together with the first wheel 14 by means of the first recesses 281, the second recesses 282, and the curved trenches 283 for the present opener to posed in not-in-use position, operation position, and penetrating one respectively. The cut into the seam wall formed when the opener is in the penetrating position becomes an initial position that helps the can opener held on the can stably.

3. The first straight section and the curved section of the abutment member 29 for guiding the movement of the can work well together the traction wheel 4 to hold a can under the present opener stably, helping the opener to be operated smoothly.

4. The connecting protrusions 142, 284 of the wheels 14, 28 are inserted into the holding holes 12, and 25 of the levers 1, and 2 so that the wheels 14, 28 can't possibly turn relative to the respective levers 1, 2 when the levers are operated.

5. The opener is less likely to be raised from the original position by a slightly raised section of the can that has been passed through the opener and cut by the cutting wheel 3, because the second straight section of the abutment member 29 doesn't touch the can top. Consequently, the cut around the periphery of the can top will form a loop, allowing easy removal of the can top.

6. When the domed protrusions 141 are moved from the curved trenches 283 to the second recesses 282 causing short retreat of the cutting wheel blade 31 from the initial cut into a can wall, the opener can sever the can wall smoothly, and still hold the can stably.

What is claimed is:

1. A can opener, comprising a traction wheel having a gripping surface, and a spindle sticking out from the gripping surface;

a first lever pivoted to the spindle at a first section thereof with an elastic member being provided to bias the traction wheel away from the first section along an axis of the spindle;

a second lever pivoted to the spindle at a first section thereof with a holding room being formed between the first section thereof and that of the first lever, and with the gripping surface of the traction wheel being faced with an outer side of the first section thereof;

a cutting wheel rotatably fitted to the second lever with a blade thereof sticking out from the first section of the second lever to be adjacent to, and spaced apart form, the traction wheel so that a spindle thereof is substantially perpendicular to the traction wheel spindle;

an actuating member disposed at an outer side of the first section of the first lever and affixed to other end of the traction wheel spindle;

the first lever having a first wheel affixed thereto in the holding room;

the first wheel having domed protrusions spaced apart around the traction wheel spindle; the second lever having a second wheel affixed thereto in the holding room; the second wheel having first recesses spaced around the traction wheel spindle to correspond to the domed protrusions; the second wheel having second recesses spaced between the first recesses that are shallower than the first ones; the second wheel having curved trenches spaced between the second recesses that are shallower than the second recesses; the first recesses sitting on the domed protrusions so that the traction wheel is biased away from the cutting wheel to open a gap between both for receiving a seam wall of a can when one of the levers is pivoted away from the other to not-in-use position; the curved trenches sitting on the domed protrusions so that the actuating member together with the first lever are moved away from the second lever to cause movement of the traction wheel close to the cutting wheel for closing the gap when one of the levers is pivoted relative to the other to in-use position, allowing a can seam wall disposed in the gap to be penetrated by the cutting wheel blade;

whereby flat areas of the first wheel stay parallel to flat areas of the second wheel in a course of one of the levers being pivoted on the other, preventing change of orientation of the axis of the traction wheel spindle.

2. The can opener according to claim 1, wherein an abutment member, is affixed to the first section of the second lever for guiding the movement of the can in relation to the opener during a cutting operation; the abutment member including a first straight section, and a curved section lower than the first straight section to sit on an edge of a top of the can wall, and a middle portion of the can top respectively.

* * * * *